US009368873B2

(12) United States Patent
Myszne et al.

(10) Patent No.: US 9,368,873 B2
(45) Date of Patent: Jun. 14, 2016

(54) TRIPLE-BAND ANTENNA AND METHOD OF MANUFACTURE

(75) Inventors: Jorge Myszne, San Jose, CA (US); Ofer Markish, Emek Hefer (IL)

(73) Assignee: QUALCOMM INCORPORATED, San Diego, CA (US)

( * ) Notice: Subject to any disclaimer, the term of this patent is extended or adjusted under 35 U.S.C. 154(b) by 696 days.

(21) Appl. No.: 13/052,736

(22) Filed: Mar. 21, 2011

(65) Prior Publication Data

US 2011/0279338 A1 Nov. 17, 2011

Related U.S. Application Data

(60) Provisional application No. 61/333,957, filed on May 12, 2010.

(51) Int. Cl.

| | |
|---|---|
| ***H01Q 21/30*** | (2006.01) |
| ***H01Q 9/28*** | (2006.01) |
| ***H01Q 1/24*** | (2006.01) |
| ***H01Q 1/38*** | (2006.01) |
| ***H01Q 3/26*** | (2006.01) |
| ***H01Q 9/04*** | (2006.01) |
| ***H01Q 21/06*** | (2006.01) |

(52) U.S. Cl.

CPC ..... *H01Q 9/285* (2013.01); *H01Q 1/243* (2013.01); *H01Q 1/38* (2013.01); *H01Q 3/26* (2013.01); *H01Q 9/0407* (2013.01); *H01Q 21/065* (2013.01); *Y10T 29/49016* (2015.01)

(58) Field of Classification Search

USPC ..... 343/700 MS, 725–730

See application file for complete search history.

(56) References Cited

U.S. PATENT DOCUMENTS

| | | | | |
|---|---|---|---|---|
| 3,887,925 | A * | 6/1975 | Ranghelli et al. | 343/795 |
| 4,719,470 | A * | 1/1988 | Munson | 343/700 MS |
| 4,864,314 | A * | 9/1989 | Bond | 343/700 MS |
| 6,359,596 | B1 * | 3/2002 | Claiborne | 343/795 |
| 6,624,793 | B1 * | 9/2003 | Su | H01Q 5/357 343/793 |
| 6,650,301 | B1 * | 11/2003 | Zimmerman | H01Q 9/26 343/795 |
| 7,023,386 | B2 * | 4/2006 | Habib et al. | 343/700 MS |
| 8,018,384 | B2 * | 9/2011 | Floyd et al. | 343/700 MS |
| 8,228,235 | B2 * | 7/2012 | Habib et al. | 343/700 MS |
| 8,502,735 | B1 * | 8/2013 | Moosbrugger et al. | 343/700 MS |
| 2004/0140941 | A1 * | 7/2004 | Joy et al. | 343/795 |
| 2004/0196191 | A1 * | 10/2004 | Hung et al. | 343/700 MS |
| 2004/0212545 | A1 | 10/2004 | Li et al. | |
| 2006/0273977 | A1 * | 12/2006 | Ke | H01Q 9/285 343/795 |
| 2006/0276157 | A1 * | 12/2006 | Chen et al. | 455/333 |
| 2006/0284780 | A1 * | 12/2006 | Chen | H01Q 9/26 343/795 |
| 2007/0001918 | A1 * | 1/2007 | Ebling et al. | 343/753 |
| 2007/0063056 | A1 * | 3/2007 | Gaucher et al. | 235/492 |
| 2007/0103380 | A1 * | 5/2007 | Weste | 343/907 |
| 2008/0309563 | A1 | 12/2008 | Wang et al. | |
| 2009/0009399 | A1 * | 1/2009 | Gaucher et al. | 343/700 MS |
| 2009/0179813 | A1 * | 7/2009 | Turner | H01Q 9/44 343/793 |
| 2009/0184876 | A1 | 7/2009 | Liu | |
| 2009/0322643 | A1 * | 12/2009 | Choudhury | 343/851 |
| 2010/0039344 | A1 | 2/2010 | Chang | |
| 2010/0149751 | A1 * | 6/2010 | Camacho | G06F 1/1616 361/679.55 |

* cited by examiner

*Primary Examiner* — Allyson Trail

(57) ABSTRACT

A triple-band antenna for transmitting and receiving low-frequency band signals and high-frequency band signals. The triple-band antenna includes a printed antenna having two wings for transmitting and receiving low-frequency signals; and an antenna array including a plurality of radiating elements being printed on one of the wings of the printed antenna, wherein the antenna array transmits and receives the high-frequency band signals, wherein one of the wings of the printed dipole is a ground for the antenna array.

27 Claims, 4 Drawing Sheets

TRIPLE-BAND ANTENNA AND METHOD OF MANUFACTURE

CROSS-REFERENCE TO RELATED APPLICATIONS

This application claims the benefit of U.S. provisional application No. 61/333,957 filed on May 12, 2010, the contents of which are herein incorporated by reference.

TECHNICAL FIELD

The present invention relates generally to antennas for portable wireless communication devices, and particularly to triple-band antennas.

BACKGROUND OF THE INVENTION

The 60 GHz band is an unlicensed band which features a large amount of bandwidth and a large worldwide overlap. The large bandwidth means that a very high volume of information can be transmitted wirelessly. As a result, multiple applications, that require transmission of a large amount of data, can be developed to allow wireless communication around the 60 GHz band. Examples for such applications include, but are not limited to, wireless high definition TV (HDTV), wireless docking station, wireless Gigabit Ethernet, and many others.

The objective of the industry is to integrate 60 GHz band applications with portable devices including, but not limited to, netbook computers, tablet computers, smart phones, laptop computers, and the like. The physical size of such devices is relatively small, thus the area for installing additional circuitry to support 60 GHz applications is limited. For example, an assembly of a lid of a laptop or netbook computer typically includes a cellular antenna to communicate with a cellular network, a Wi-Fi antenna to receive and transmit signals from an access point of a wireless network, and a webcam. To support communication in the 60 GHz band, active antennas should be also assembled in the lid. To avoid problems of signal interferences, the various antennas should be positioned at a predefined distance from each other.

In order to save space, portable devices are now designed with a dual band Wi-Fi antenna that operates in the frequency bands of 2.4 GHx and 5 GHz. One example for such an antenna is a dipole printed antenna as schematically shown in FIG. 1. The antenna 100 includes two printed dipole strips 110 (hereinafter wings) and an electrical transmission line 120 that acts as an unbalanced-to-balanced transformer between a feed coaxial line 130 and the two printed dipole strips 110. The total length of a dipole strip is approximately a ¼ wavelength of a signal at 2.4 GHz. The electrical line 120 and the dipole strips 110 are printed on the same plane and fabricated on the same substructure. The physical dimensions of the antenna 100 are a function of the wavelength of the low frequency band (e.g., 2.4 GHz). For example, based on the specific implementation, the dimension of a dual band printed antenna is $L \times W = 60 \times 10\ mm^2$. Trying to support a 60 GHz band using a conventional dipole antenna, such as shown in FIG. 1, is not feasible as the antenna gain would be too low in order to enable efficient transmission and reception of radio frequency signals.

Therefore, it would be advantageous to provide a triple-band antenna that is versatile and can provide high performance in a compact size for both low and high frequency bands.

SUMMARY OF THE INVENTION

Certain embodiments disclosed herein include a triple-band antenna for transmitting and receiving low-frequency band signals and high-frequency band signals. The triple-band antenna includes a printed antenna having two wings for transmitting and receiving low-frequency signals; and an antenna array including a plurality of radiating elements being printed on one of the wings of the printed antenna, wherein the antenna array transmits and receives the high-frequency band signals, wherein the one of the wings is a ground for the antenna array.

Certain embodiments disclosed herein also include a method for manufacturing a triple-band antenna. The method includes printing, using a fabrication process, a dipole antenna having two wings; connecting a first feed wire at a connecting point of the two wings using a connector; suspending an array of a plurality of radiating elements over one of the wings; connecting each radiating element to a second feed wire and a radio frequency integrated circuit (RFIC) high-frequency band transceiver; grounding each of the second feed wire to the one of the wings; and mounting the resulted structure on an insulated board.

BRIEF DESCRIPTION OF THE DRAWINGS

Various embodiments are particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION OF THE INVENTION

Figure 1:
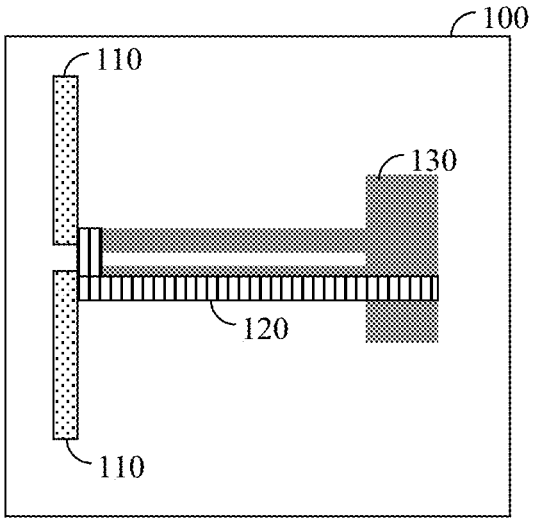
FIG. 1 is a diagram of an on-chip dipole antenna.

The embodiments disclosed by the invention are only examples of the many possible advantageous uses and implementations of the innovative teachings presented herein. In general, statements made in the specification of the present application do not necessarily limit any of the various claimed inventions. Moreover, some statements may apply to some inventive features but not to others. In general, unless otherwise indicated, singular elements may be in plural and vice versa with no loss of generality. In the drawings, like numerals refer to like parts through several views.

Figure 2:
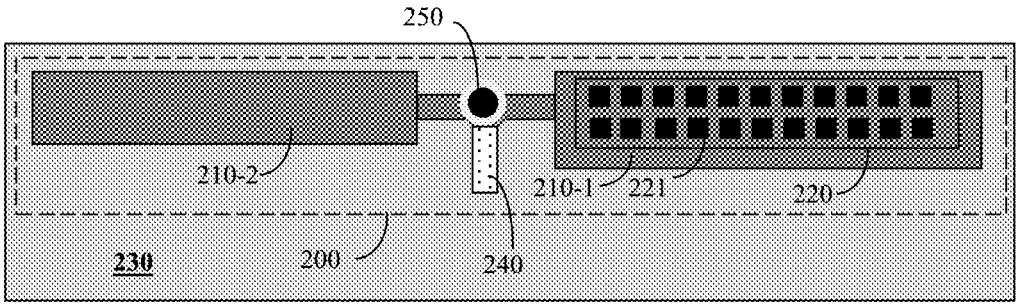
FIG. 2 is a schematic diagram of a triple-band antenna constructed in accordance with an embodiment of the invention.

FIG. 2 shows a schematic diagram of a triple-band antenna 200 constructed in accordance with an embodiment of the invention. The antenna 200 is designed to receive and transmit radio frequency (RF) signals at three different frequency bands. In accordance with an embodiment of the invention, these bands include, but are not limited to 60 GHz, 2.4 GHz, and 5 GHz, thereby supporting applications in both the Wi-Fi and 60 GHz bands.

The triple-band antenna 200 is installed on an insulated board 230 of a portable wireless device. Such device may include, but is not limited to, a smart phone, a personal digital assistant (PDA), a laptop computer, a netbook computer, a tablet computer, and the like.

The triple-band antenna 200 includes a printed dipole having two wings 210-1 and 210-2 and a phase array 220 fabricated on the same substrate. Specifically, the one printed dipole's wing (e.g., 210-1) serves as a ground to a phase array antenna. The other wing (210-2) is shaped to provide the radiating elements for signals transmitted or received in the 2.4 GHz and 5 GHz frequency bands. A feed line 240, which may be a coaxial line or other suitable radio-frequency signal path structure, is connected to the printed dipole (wings 210-1, 210-2) using a connector 250. The connector 250 may be a mini micro coaxial connector (UFL) connector or other suitable attachment structure.

The phase array 220 is the 60 GHz antenna and, in one embodiment of the invention, is based on a patch antenna. Specifically, the substrate of the phase array 220 consists of N radiating elements 221, each with a phase shifter. For exemplary purposes only and without departing from the scope of the invention, only one radiating element 221 is labeled. Beams are formed by shifting the phase of the signal emitted from each radiating element. The ground of the phase array 220 is one of the wings of the printed dipole 210, e.g., wing 210-1. In accordance with an exemplary embodiment of the invention, the tripe-band antenna may be implemented with antenna array that are not of a phased array antenna.

The physical dimensions of the triple-band antenna 200 are based on the low frequency band. The length of each wing is $\lambda\backslash 4$, where $\lambda$ is a wavelength of a low frequency band signal being transmitted (e.g., 2.4 GHz). The low frequency band (e.g., 2.4 GHz or 5 GHz) can operate concurrently and without interfering with the high frequency band (e.g., 60 GHz), as the wing of the low band serves as the ground for the high band. It should be noted that the beam of the 60 GHz band signal outputted by the phase array 220 is narrow, thus when the beam is emitted from the wing 210-1, the radiating element of the wing 210-2 does not interrupt the reception of the signal. On the other hand, for the printed dipole, the phase array patches and any circuitry installed thereon are just areas where the metal is thicker, and as such the dipole's properties are not affected.

In an embodiment of the invention, one of the dipole wings can be curled in order to fit to the dimensions of the board on which the antenna is printed. In another exemplary embodiment of the invention, the number of radiating elements in the phase array 220 is 16 and the physical dimensions of the triple-band antenna 200 are approximately 50 mm by 7 mm.

Figure 3:
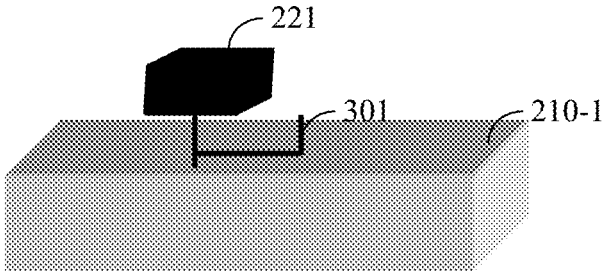
FIG. 3 is an exemplary and non-limiting diagram showing a connection of a radiating element of a phase array antenna to a wing of a printed dipole antenna.

The physical connection of the phase array's radiating elements 221 to the dipole wing 210-1 may be in a form of a patch antenna. That is, each radiating element 221 is suspended over a ground plane, e.g., over the dipole wing 210-1. An exemplary and non-limiting diagram showing such connection is provided in FIG. 3.

As illustrated, the feed wire 301, which may be a coaxial line or other suitable radio-frequency signal path structure of the radiating element, connects the radiating element to the ground (wing 210-1) and to a high-frequency band transceiver. For example, an inner conductor of a coaxial line is the connection to transceiver, and a tubular conducting shield is connected to the ground. The frequency band transceiver implements at least the beam forming function of the phase array antenna.

Figure 4:
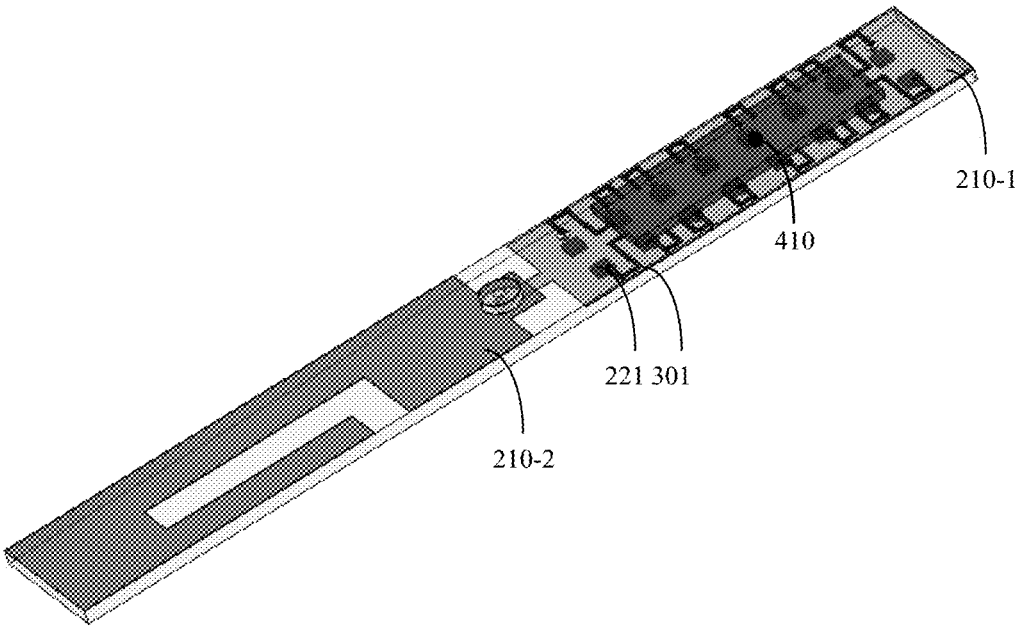
FIG. 4 shows an embodiment of the invention for mounting a triple-band antenna of an high-frequency band RFIC transceiver onto a board.

In accordance with another embodiment of the invention, in order to save additional space on the board, the high-frequency band transceiver can be mounted on the triple-band antenna 200. An exemplary diagram of such implementation is shown in FIG. 4. The high-frequency band transceiver 410 is an RF integrated circuit (IC) that transmits and receives RF signals over the 60 GHz frequency band. It should be appreciated that such an implementation allows for shortening the length of the feed wires (or traces) 301 connecting the transceiver 410 to elements 221 of the phase array 220, thereby minimizing the energy lost on such connections.

Figure 5A:
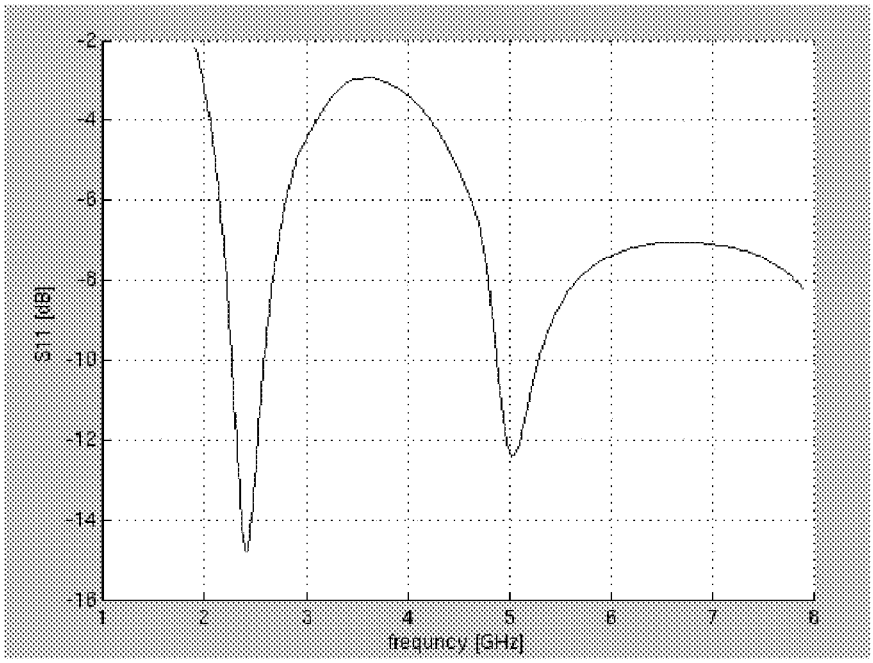
FIGS. 5A and 5B depict graphs of return loss varying with frequency results simulated for the triple-band antenna.
Figure 5B:
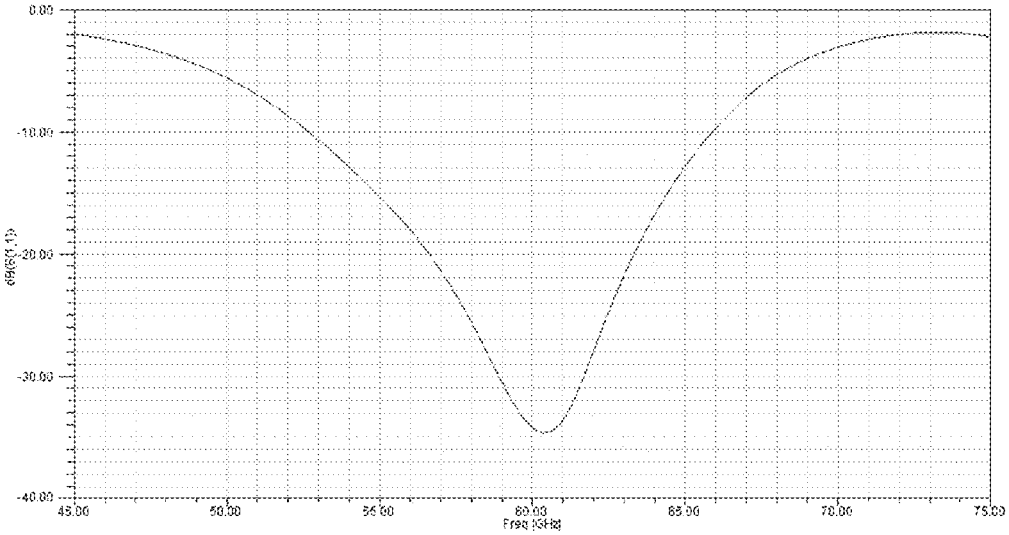

FIGS. 5A and 5B show examples of test result graphs of the return loss varying with frequency as simulated for the triple-band antenna 200. The triple-band antenna 200 generates three resonant frequencies near the frequencies of 2.4 GHz and 5 GHz (FIG. 5A) and the frequency of 60 GHz (FIG. 5B) during the test, respectively. When the return loss (S11) is below −10 db at a given frequency, it is an indication of the operation frequency of the antenna. Therefore, as depicted in FIGS. 5A and 5B the operation frequencies are around 2.4 GHz, 5 GHz, and 60 GHz, respectively. Only for exemplary purposes, the return loss results are shown in two graphs.

Figure 6:
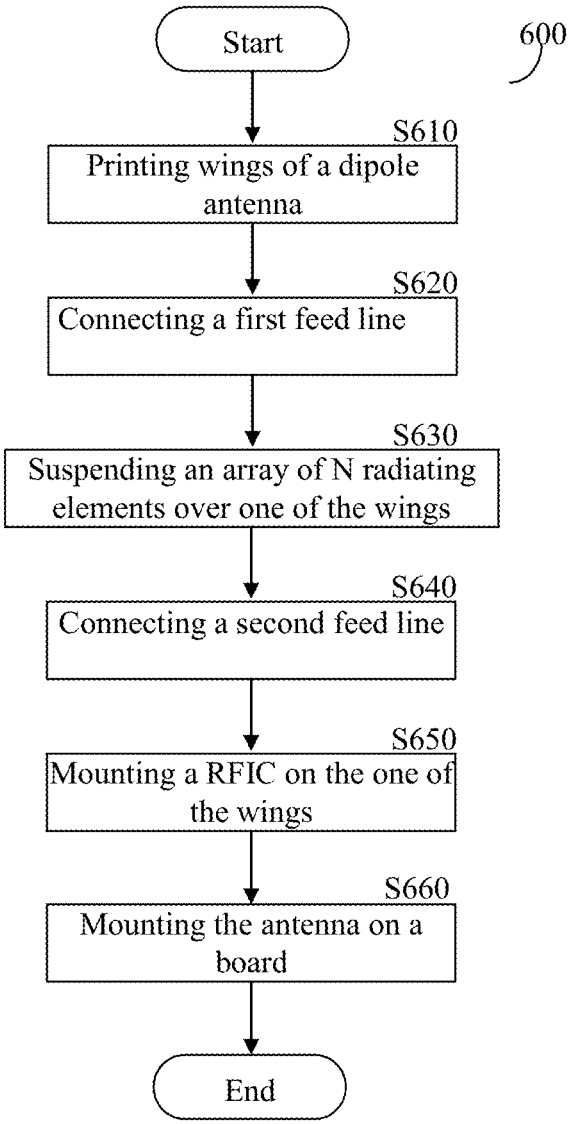
FIG. 6 is a flowchart describing an exemplary manufacturing process of the triple-band antenna.

FIG. 6 shows a non-limiting flowchart 600 describing a manufacturing process of the triple-band antenna 200 according to an embodiment of the invention. At S610, two wings in a form of a dipole antenna are printed on a conductive substrate. The printed antenna may be an on-chip dipole antenna shown in FIG. 1. However, according an embodiment of the invention, the dipole strips are the wings, where the length of each wing is a quarter of a wavelength of 2.4 GHZ signal. The wings of the printed dipole can receive and transmit RF signals at frequency bands of 2.4 GHz and 5 GHz. At S620, a first feed wire is connected at a connecting point of the wings using a connector.

At S630, a number of N (N is an integer number greater than 1) radiating elements are fabricated on the same substrate as the printed dipole, where all radiating elements are suspended over one of the wings. At S640, a second feed wire is connected to each of the radiating elements and to a high-frequency band transceiver. Optionally, at S650, an RFIC high-frequency band transceiver, having physical dimensions less than the dimensions of a wing, is mounted over the wing having the array of radiating elements. At S660, the resulted structure is mounted on an insulated board.

It is important to note that these embodiments are only examples of the many advantageous uses of the innovative teachings herein. Specifically, the innovative teachings disclosed herein can be adapted in any type of consumer electronic devices where reception and transmission of millimeter wave signals is needed. Moreover, some statements may apply to some inventive features but not to others. In general, unless otherwise indicated, it is to be understood that singular elements may be in plural and vice versa with no loss of generality.

The manufacturing process disclosed herein can be implemented in hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. An apparatus, comprising:

a printed antenna having two wings for transmitting and receiving low-frequency band signals; and an active antenna array including a plurality of radiating elements disposed on one of the two wings of the printed antenna, wherein the active antenna array is configured to transmit and receive high-frequency band signals, wherein the one of the two wings of the printed antenna serves as a ground plane for the active antenna array, and wherein each of the radiating elements is connected to the ground plane via a respective first feed wire.

2. The apparatus of claim 1 further comprising an insulated board, wherein the printed antenna is installed on the insulated board.

3. The apparatus of claim 1, wherein the two wings of the printed antenna are of a printed dipole.

4. The apparatus of claim 1, wherein a length of each of the two wings is a quarter of a wavelength of the low-frequency band signals.

5. The apparatus of claim 4, wherein a frequency of the low-frequency band signals is 2.4 GHz.

6. The apparatus of claim 1, wherein a frequency of the low-frequency band signals is at least one of 2.4 GHz or 5 GHz.

7. The apparatus of claim 1, wherein the high-frequency band signals are 60 GHz signals.

8. The apparatus of claim 1, wherein the active antenna array is at least a phase array.

9. The apparatus of claim 1, wherein each of the plurality of radiating elements is suspended over the one of the two wings.

10. The apparatus of claim 1, wherein each of the plurality of radiating elements is connected to a radio frequency integrated circuit (RFIC) high-frequency band transceiver via the respective first feed wire.

11. The apparatus of claim 10, wherein the RFIC high-frequency band transceiver is mounted on the active antenna array.

12. The apparatus of claim 1, wherein the two wings of the printed antenna are connected to a low-frequency band transceiver via a second feed wire and a connector.

13. The apparatus of claim 12, wherein the connector comprises a mini micro coaxial connector (UFL) connector, and wherein the second feed wire is attached to a connecting point of the two wings.

14. A method for manufacturing an apparatus, comprising:

printing a dipole antenna having two wings for transmitting and receiving low-frequency band signals;

connecting a first feed wire to a connecting point of the two wings;

suspending an array of a plurality of radiating elements over one of the two wings;

connecting each of the plurality of radiating elements to a respective second feed wire and a radio frequency integrated circuit (RFIC) high-frequency band transceiver;

grounding each of the second feed wires to the one of the two wings; and mounting a resulting structure on an insulated board, wherein the plurality of radiating elements is configured to transmit and receive high frequency band signals, and wherein the one of the two wings of the dipole antenna serves as a ground plane for the plurality of radiating elements.

15. The method of claim 14, further comprising:

mounting the RFIC high-frequency band transceiver on the one of the two wings.

16. The method of claim 14, wherein a length of each of the two wings is a quarter of a wavelength of a low-frequency band signal.

17. A method for wireless communication, comprising:

at least one of transmitting low-frequency band signals from or receiving low-frequency band signals at a printed antenna having two wings;

at least one of transmitting high-frequency band signals from or receiving high-frequency band signals at an active antenna array including a plurality of radiating elements disposed on one of the two wings of the printed antenna, wherein the one of the two wings of the printed antenna serves as a ground plane for the active antenna array, and wherein each of the radiating elements is connected to the ground plane via a respective first feed wire.

18. The method of claim 17, further comprising installing the printed antenna on an insulated board.

19. The method of claim 17, wherein the two wings of the printed antenna are of a printed dipole.

20. The method of claim 17, wherein a length of each of the two wings is a quarter of a wavelength of the low-frequency band signals.

21. The method of claim 17, wherein a frequency of the low-frequency band signals is at least one of 2.4 GHz or 5 GHz signals.

22. The method of claim 17, wherein the active antenna array is at least a phase array.

23. The method of claim 17, further comprising suspending each of the plurality of radiating elements over the one of the two wings.

24. The method of claim 17, further comprising connecting each of the plurality of radiating elements to a radio frequency integrated circuit (RFIC) high-frequency band transceiver via the respective first feed wire.

25. The method of claim 24, further comprising mounting the RFIC high-frequency band transceiver on the active antenna array.

26. The method of claim 17, further comprising connecting the two wings of the printed antenna to a low-frequency band transceiver via a second feed wire and a connector.

27. A wireless device, comprising:

a conductive substrate;

an antenna having two wings for transmitting and receiving low-frequency band signals, wherein the antenna is printed on the conductive substrate; and an active antenna array including a plurality of radiating elements being disposed on one of the two wings of the printed antenna, wherein the active antenna array is configured to transmit and receive high-frequency band signals, wherein the one of the wings of the printed antenna serves as a ground plane for the active antenna array, and wherein each of the radiating elements is connected to the ground plane via a respective feed wire.

* * * * *